US007419056B2

(12) United States Patent
Gattefosse et al.

(10) Patent No.: US 7,419,056 B2
(45) Date of Patent: Sep. 2, 2008

(54) RIGID PLASTIC PROTECTIVE CASE FOR A BLISTER PACK

(75) Inventors: Hervé Gattefosse, Villetelle (FR); Patrick Sivera, Saint Sauveur (FR)

(73) Assignee: Sanofi-Aventis, Paris (FR)

( * ) Notice: Subject to any disclaimer, the term of this patent is extended or adjusted under 35 U.S.C. 154(b) by 168 days.

(21) Appl. No.: 10/530,564

(22) PCT Filed: Oct. 7, 2003

(86) PCT No.: PCT/EP03/50699

§ 371 (c)(1),
(2), (4) Date: Oct. 12, 2005

(87) PCT Pub. No.: WO2004/035414

PCT Pub. Date: Apr. 29, 2004

(65) Prior Publication Data

US 2006/0118452 A1 Jun. 8, 2006

(30) Foreign Application Priority Data

Oct. 14, 2002 (FR) ..... 02 12719

(51) Int. Cl.
*B65D 83/04* (2006.01)
*A45C 13/10* (2006.01)

(52) U.S. Cl. ..... 206/531; 206/1.5; 206/539

(58) Field of Classification Search ..... 206/531–532, 206/534, 538–539, 1.5, 807; 221/87–89
See application file for complete search history.

(56) References Cited

U.S. PATENT DOCUMENTS

| | | | | |
|---|---|---|---|---|
| 3,587,517 | A | 6/1971 | Truckenmiller et al. | |
| 3,921,804 | A * | 11/1975 | Tester | 206/531 |
| 4,384,649 | A * | 5/1983 | Brodsky | 206/538 |
| 4,660,991 | A | 4/1987 | Simon | |
| 4,998,623 | A | 3/1991 | Doull | |
| 5,109,984 | A | 5/1992 | Romick | |
| 5,323,907 | A | 6/1994 | Kalvelage | |
| 5,489,025 | A * | 2/1996 | Romick | 206/531 |
| 5,988,429 | A | 11/1999 | Coe | |
| 6,021,901 | A * | 2/2000 | Wolfe | 206/531 |
| 6,082,544 | A | 7/2000 | Romick | |
| 6,338,408 | B1 * | 1/2002 | Anderson | 206/538 |

* cited by examiner

*Primary Examiner*—Bryon P Gehman
(74) *Attorney, Agent, or Firm*—Young & Thompson

(57) ABSTRACT

A protective case for a blister pack containing medicines, includes a semi-rigid horizontal upper panel having cells delimiting housings open at the bottom and which are obturated by covers with each housing containing medicine. The case includes:

perforated horizontal bottom upon which the lower face of the blister pack lays; and a perforated upper panel which covers the upper face of the blister pack; wherein the blister pack is trapped between the bottom and the upper panel each of which includes holes coinciding with the location of the cells, the case having elements for fixing the upper panel with respect to the bottom, and the bottom and the upper panel of the case are made of rigid plastic.

19 Claims, 3 Drawing Sheets

RIGID PLASTIC PROTECTIVE CASE FOR A BLISTER PACK

BACKGROUND OF THE INVENTION

The invention relates to a protective case for a blister pack containing medicines.

The invention relates more particularly to a protective case for a blister pack containing medicines intended for clinical trials, of the type comprising a semi-rigid horizontal upper panel comprising blister-shaped cells delimiting housings open at the bottom and which are obturated by covers and each of which contains a medicine able to be expelled by the flat lower face of the blister pack by tearing the cover of the blister.

The case is of the type comprising:

a perforated horizontal bottom upon which the lower face of the blister pack lays; and a perforated upper panel which covers the upper face of the blister pack;

and of the type in which the blister pack is trapped between the bottom and the upper panel each of which comprise holes coinciding with the location of the cells, the case comprising means of fixing the upper panel with respect to the bottom, the bottom and the upper panel of the case being made of rigid plastic.

A medicine is subjected to clinical tests before being marketed. For example, the effectiveness of the medicine is tested by administering the active constituent to a first group of sick people and by administering a placebo to a second control group of sick-people.

It is known to deliver the medicine sealed in a blister pack in a case in the form of a wallet with which is integrated an information notice relating to the medicine that it contains. The blister pack is trapped in the case, or wallet, in such a way that the medicine is always accompanied by the corresponding notice.

In the context of clinical studies, referred to as double-blind, the cases must be indiscernible from each other whatever their contents may be: placebo or active constituents.

According to a known example, the case consists of a folded sheet of flexible cardboard comprising a central panel flanked by two lateral flaps that can be folded down over the central panel.

The blister pack is trapped between the central panel and a first lateral flap. The central panel and the first flap are each perforated with holes coinciding with the location of the cells. The perforated flap is then folded down and then sealed on the central panel, for example by pasting. The holes in the central panel allow the ejection of the medicine by pressure on the cell and tearing of the cover, the medicine then being retrieved under the lower face of the case.

The second lateral flap forms a protective lid for the cells of the blister pack. The information notice corresponding to the medicines is located on one or both of the faces of the lid.

Such a case in particular makes it possible to use the contents of the blister pack without ever separating the notice. The switching of medicines or a placebo is thus prevented.

Furthermore, any attempt at tampering with the case generally results in visible damage.

However, such a case made of cardboard is flexible and deforms in use. Furthermore, the cardboard is more likely to become deformed if it is exposed to a damp atmosphere.

Furthermore, it can be envisaged that when a case is tampered with, the damage may be camouflaged by pasting the perforated lateral flap back onto the central panel.

Finally, the packaging of the blister pack in such a case necessitates a first operation of positioning of the blister pack in the pre-pasted case and then an operation of pasting the perforated flap onto the central panel, which can take up to 7 seconds.

The document U.S. Pat. No. 3,587,517 describes a case which comprises a rigid bottom upon which a rigid flap is mounted such that it rotates about a lateral hinge. A blister pack of medicine is intended to be inserted flat between the bottom and the flap. The bottom and the flap comprise holes coinciding with the locations of the cells of the blister pack. The case also comprises a rigid lid which is mounted such that it rotates with respect to the bottom between a position folded down over the flap in such a way as to protect the cells from shocks and an open position in which the cells are accessible.

However, this case is not suitable for use in the context of clinical trials. The case is in fact reusable, since the flap comprises reversible means of closure with respect to the bottom. It is therefore possible to substitute the original blister pack with a similar one but containing substances of different nature without the appearance of the case revealing such a substitution. In order for the results of the clinical trials to be reliable, it is therefore essential that the case should be tamper-proof once the blister pack is trapped between the bottom and the flap.

SUMMARY OF THE INVENTION

In order to improve the packaging time and to solve the other problems mentioned above, the invention proposes a case of the type described previously, characterized in that the fixing means are elastic interlocking means that cannot be dismantled.

According to other features of the invention:

the case comprises at least one pin forming a stop for the horizontal positioning the blister pack with respect to the ejection holes in the bottom of the case;

the pin constitutes a male element of the elastic interlocking fixing means, the female element being carried by the upper panel;

the male element and the female element are formed in one piece with the bottom and with the top panel respectively;

the bottom comprises a rim that extends vertically upwards and which surrounds the upper panel;

the upper panel is a flap that is mounted such that it articulates about a transverse axis by means of a first hinge on one side of the bottom which has no vertical rim;

the first hinge is formed by a plastic film which is formed in one piece with the bottom and with the upper panel;

the first hinge forms a stop for positioning the blister pack with respect to the holes in the bottom;

the case comprises an upper lid for protecting the cells which is made of rigid plastic and which is mounted such that it pivots with respect to the bottom about a second hinge between a closed position in which it envelopes the cells of the blister pack by cooperation of its shape with that of the bottom, and an open position in which the cells are accessible to a user;

the second hinge is a plastic film which is formed in one piece with the bottom and the lid;

the lid is held in the closed position by means working by cooperation of complementary shapes between the lid and the upper panel and/or the bottom;

the elastic interlocking is produced by elastic deformation of the female element.

BRIEF DESCRIPTION OF THE DRAWINGS

Other features and advantages of the invention will appear on reading the following detailed description given with reference to the appended drawings among which.

DETAILED DESCRIPTION OF THE PREFERRED EMBODIMENTS

Figure 1:
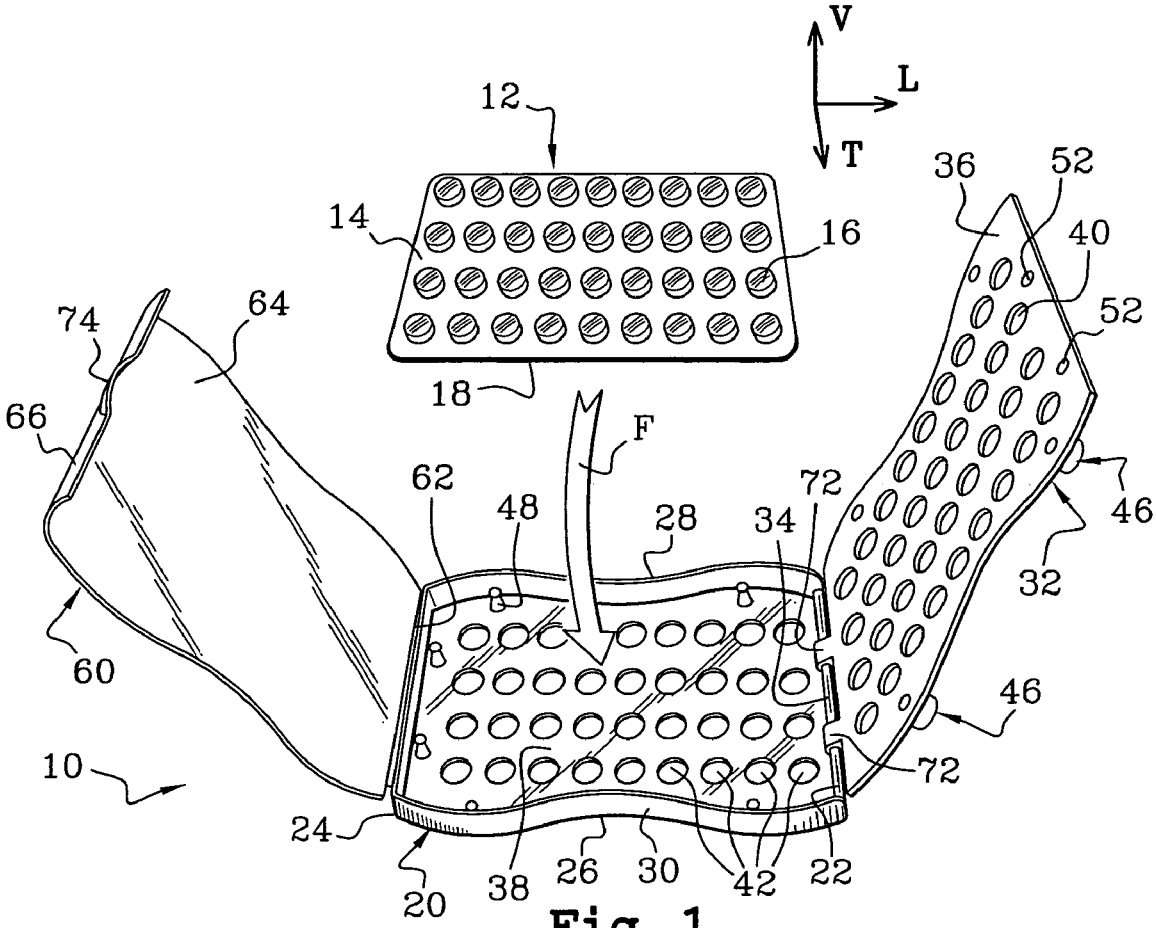
FIG. 1 is an exploded perspective view of a case produced according to the invention, the case being open and unfolded, ready to receive a blister pack of medicines.

In the rest of the description, and in a non-restrictive way, a longitudinal, vertical and transverse orientation will be used as indicated by the coordinate system L, V, T shown in FIG. 1.

FIG. 1 shows a case 10 for protecting a blister pack 12 of medicines. The case 10 is empty in this case and it is in an original unfolded state in which it is ready to receive the blister pack of medicines 12.

Figure 7:
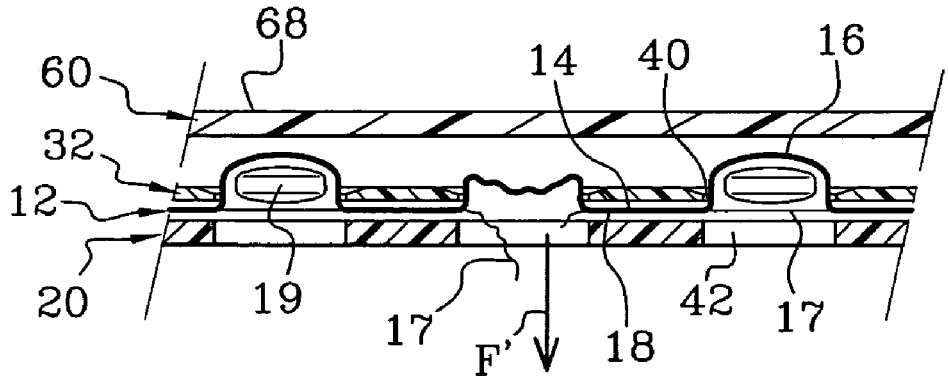
FIG. 7 is a large scale view in longitudinal cross-section through the cross-sectional plane 7-7 of FIG. 6.

In a known way, the blister pack 12 comprises a semi-rigid horizontal upper panel 14 which comprises blister-shaped cells 16 delimiting housings open in the downward direction which are obturated by covers 17 as shown in FIG. 7. Each of the housings can house a medicine 19 that can be expelled through the flat lower face 18 of the blister pack 12 by deformation of the cell 16 and by tearing of the cover 17 as illustrated by the central cell 16 in FIG. 7. The medicines 19 are for example in the form of tablets, capsules or suppositories suitable for protection by a blister pack.

The case 10 comprises in particular a central bottom 20 which is principally formed by a horizontal panel of overall rectangular shape whose short front 22 and rear 24 sides are oriented in the transverse direction and whose long sides 26 and 28 are oriented in the longitudinal direction according to FIG. 1.

The bottom 20 is in particular intended to support the flat lower face 18 of the blister pack 12 which is placed in position in the direction of the arrow F shown in FIG. 1.

The bottom panel 20 comprises a lateral rim 30 which extends vertically upwards from the two long sides 26 and 28 and from the short rear edge 24.

A flat rectangular flap 32, whose dimensions are substantially complementary to those of the bottom 20, is mounted such that it articulates about a front transverse hinge 34, on the short front side 22 of the bottom 20, between an unfolded position and a folded down position.

In the unfolded position, as shown in FIG. 1, the flap 32 totally uncovers the bottom 20 of the case 10.

Figure 2:
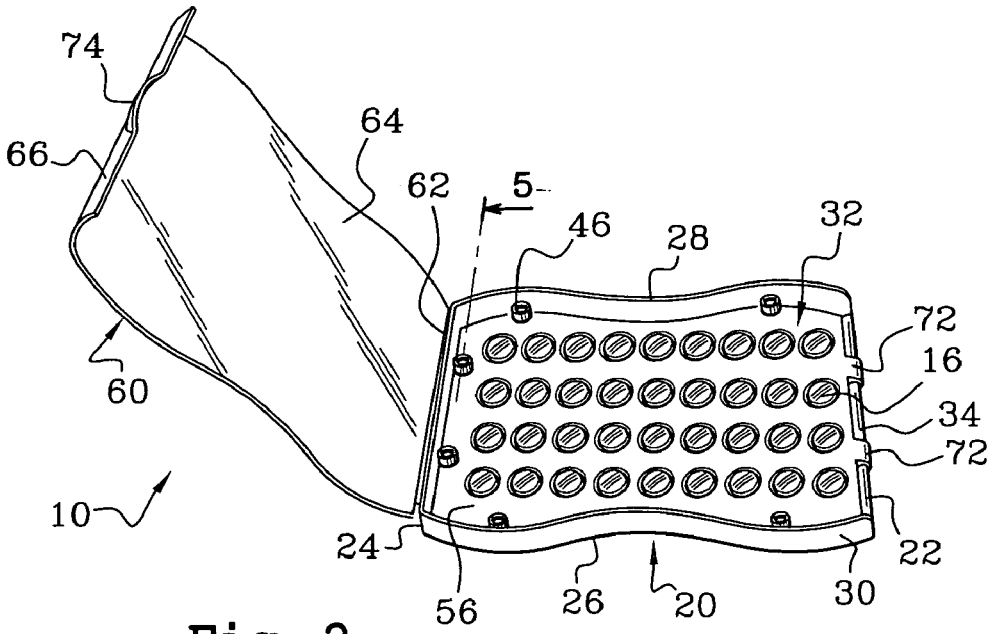
FIG. 2 shows the case of FIG. 1 with its lid in the open position which shows the blister pack of medicines trapped in the case.

In the folded down position, as shown in FIGS. 2 and 7, the flap 32 totally covers the bottom 20 in such a way as to trap the blister pack 12 between the lower face 36 of the flap 32 and the upper face 38 of the bottom 20. The flap 32 is then surrounded by the rim 30 of the bottom 20.

The flap 32 and the bottom 20 comprise holes 40 and 42 respectively which are formed such that they coincide with the locations of the cells 16 of the blister pack 12 when the flap 32 is in the folded down position. The cells 16 and the holes 40 and 42 are in this case produced in the form of four longitudinal rows of nine units.

As shown in FIG. 2, the holes 40 of the flap 32 provide the user with access to the cells 16 such that the user can thus select a medicine 19 and eject it by pressing vertically on the chosen cell 16, the medicine 19 then being ejected through the cover 17 and through the corresponding hole 42 in the bottom 20 as illustrated by the arrow F' shown in FIG. 7.

Figure 4:
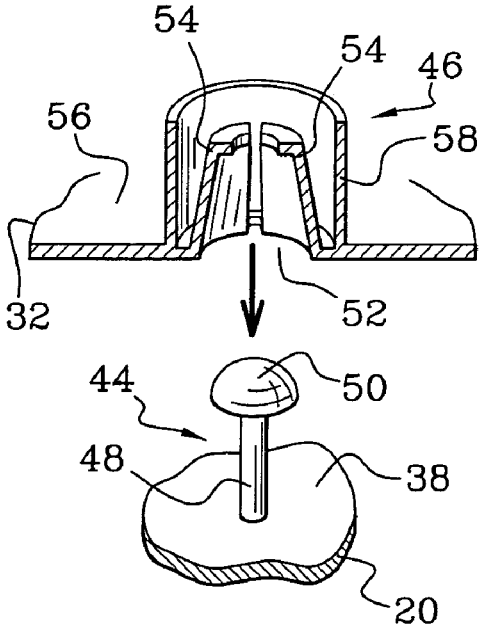
FIG. 4 is a perspective view in partial cross-section through the cross-sectional plane 4-4 of FIG. 2 showing in detail the elastic interlocking fixing means of the intermediate flap on the bottom of the case before the interlocking has taken place.

The case 10 comprises non-detachable or tamper-proof means of fixing the flap 32 in the position in which it is folded down on the bottom 20. The flap 32 is more precisely fixed by the vertical elastic interlocking of a series of pairs of elements each comprising a male element 44 and a female element 46. The fixing means are shown in greater detail in FIGS. 4 and 5.

The male element 44 consists of a pin 48 that extends vertically upwards from the upper face 38 of the bottom 20. The free end of the pin 48 comprises a hemispherical head 50 whose horizontal flat faces downwards.

The pin 48 is intended to cooperate with the corresponding female element 46 which is carried by the flap 32. According to this embodiment, the female element 46 is a pit 54 with a pierced bottom which extends vertically from the upper surface 56 of the flap 32. The pit 54 comprises a lower opening 52 intended to receive the hemispherical head 50 of the pin 48.

The pit 54 also comprises vertical slits which divide the pit 54 into two symmetrical halves in order to facilitate its elastic deformation and consequently the interlocking with the male element 44.

Figure 5:
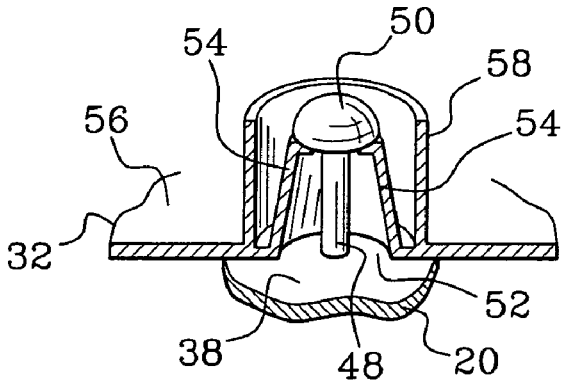
FIG. 5 is a view showing the fixing means of FIG. 4 after the interlocking has taken place.

Thus, when the pin 48 is interlocked in the female element 46, as shown in FIG. 5, the upper end of the pit 54 is butted against the downward-facing flat of the pin 48 in order to prevent any vertical movement of the flap 32 with respect to the bottom 20. The flap 32 is thus firmly attached to the bottom 20 and the blister pack 12 is trapped in the case 10.

Furthermore, the pit 54 has the shape of a truncated cone whose lower end is located in the opening 52 and which is intended to increase the resistance to unlocking by pinching effect.

As can be seen in FIG. 1, the interlock orifices 52 of the flap 32 are encircled by a skirt 58 for protecting the pairs on fixing elements 44, 46 and which extends vertically from the upper surface 56 of the flap 32 and which prevents any attempt at dismantling by separating the two halves of each pit 54.

Figure 3:
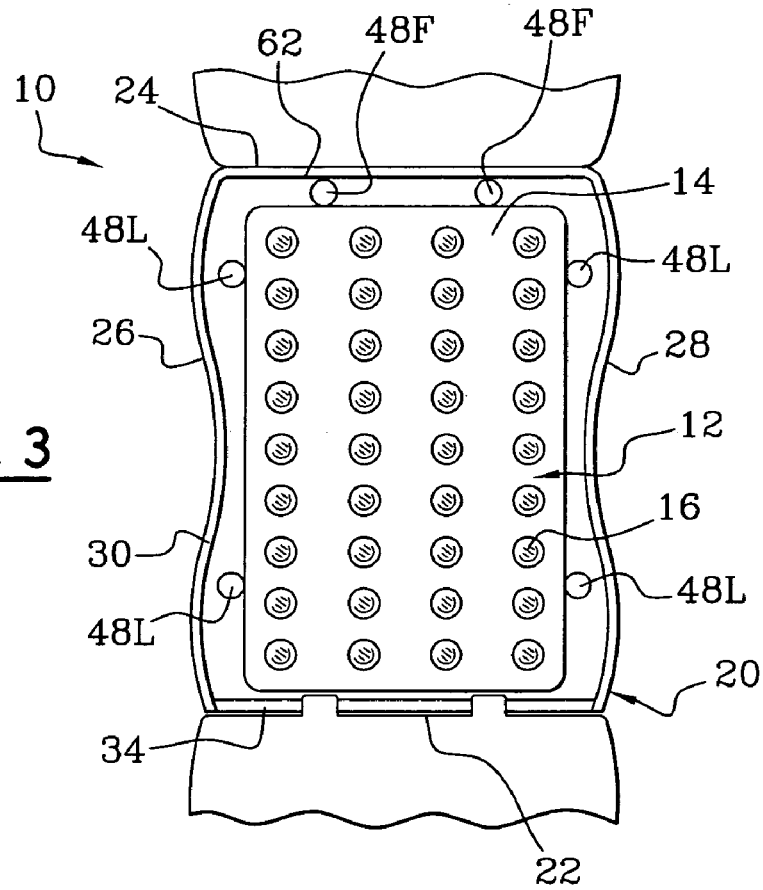
FIG. 3 is a plan view which shows the bottom of the case upon which the blister pack of medicine is positioned.

As seen in FIG. 3, the pairs of elastic interlocking fixing elements 44, 46 are six in number in this case. The pins 48 carried by the bottom 20 are distributed around the periphery of the bottom 20 at the rate of two lateral pins 48L on each of the long sides 26 and 28 of the bottom 20 and two frontal pins 48F on the rear short side 24. The pins 48 determine precisely the horizontal position of the blister pack 12 with respect to the ejection holes 42 when the latter is placed in the bottom 20 and before folding down the flap 32. The short front side 22 of the blister pack 12 is adjacent to the front hinge 34.

The pins 48 and the front hinge 34 thus advantageously form positioning stops for the blister pack 12 with respect to the bottom 20.

Figure 6:
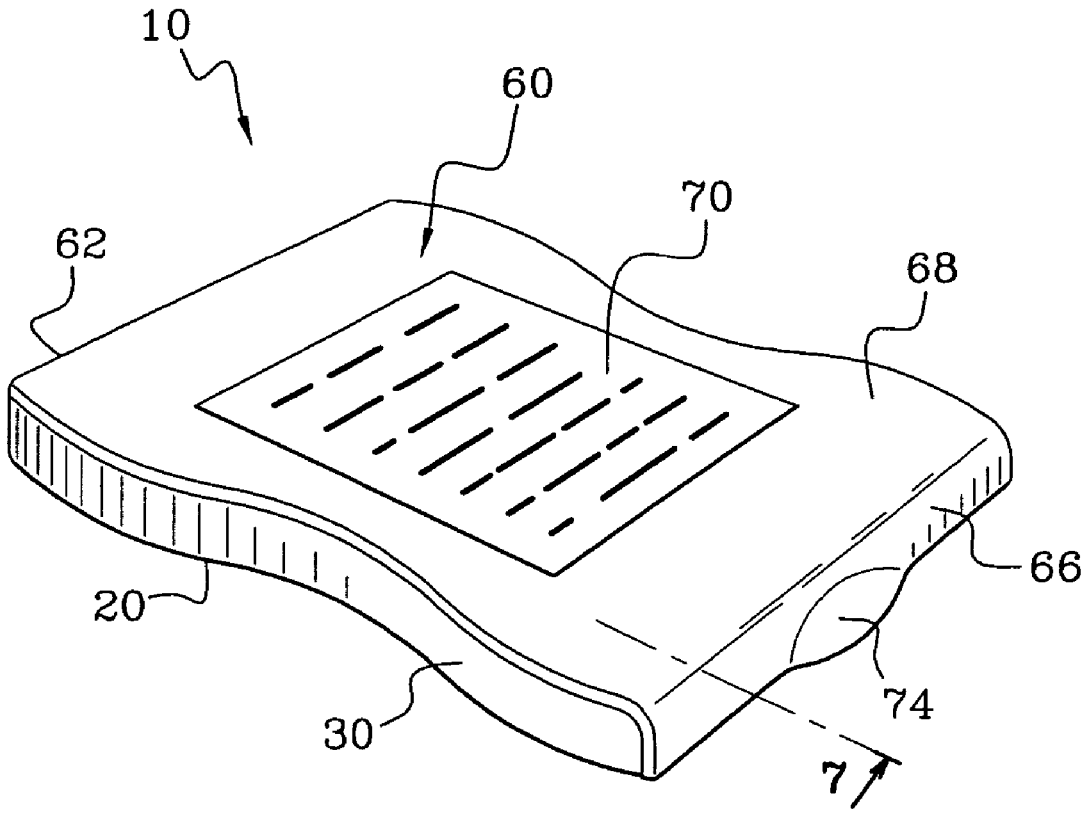
FIG. 6 shows the case of FIG. 1 with its lid in the closed position and which comprises an information notice.

The case 10 also comprises a lid 60 which is particularly visible in FIGS. 2 and 6. The lid 60 is a panel whose overall dimensions are similar to those of the bottom 20. The lid 60 is mounted such that it articulates on the upper edge of the rim 30 of the short rear side 24, about a transverse rear hinge 62, between an open position and a closed position.

In the open position, as shown in FIG. 2, the lid 60 uncovers the upper part of the blister pack 12 in such a way as to provide the user with access to the medicines 19. The lid can be opened through 180° providing totally free access to the blister pack.

In the closed position, as shown in FIG. 6, the lid 60 is globally horizontal and its lower reverse side 64 is pressed against the upper edge of the rim 30 of the bottom 20. The lid 60 comprises at its free end, that is to say the side opposite to that of the rear hinge 62, a flange 66 which extends perpendicularly from its reverse side 64 in such a way as to close the short front side 22 of the case 10 which does not have a vertical rim 30.

The lid 60 therefore encloses and protects the upper face 14 of the blister pack 12 and, in particular, the cells 16. In the closed position, only the obverse side 68 of the lid 60 is visible.

The obverse side 68 of the lid 60 can in particular serve as a support for a notice 70 giving information on the medicines 19 contained in the case 10. The notice 70 is for example pasted on the obverse side 68 or on the reverse side 64. The notice can also be printed or inscribed on the lid in sunken or in raised form.

The flap 32 comprises two tabs 72 which make it protrude beyond the front hinge 34. In the folded down position of the flap 32, these two tabs 72 extend horizontally from the short front side 22 of the case 10.

The tabs 72 are designed to hook the lid 60 in the closed position by elastic interlocking with grooves (not shown) formed in the flange 66 of the lid 60.

In the centre of the flange 66 of the lid 60 there is a protrusion 74 forming a grip to allow the user to disengage the lid 60 from the engagement of the tabs 72 in order to open the case 10 by raising it.

The case 10 is in this case made entirely of rigid plastic. The case 10 is thus resistant to shocks and its mechanical properties are not harmed by exposure to a damp atmosphere.

According to this embodiment, the case 10 is made in one piece by molding. The front 34 and rear 62 hinges are therefore each formed by a plastic film which is continuous with the bottom 20. The case 10 is advantageously made from a material of the polypropylene type such that repeated openings and closings of the lid 60 do not cause any fracturing by fatigue of the rear hinge 62 during the use of the case 10.

The pins 48 are also made in one piece with the bottom 20 and the female elements are made in one piece with the flap 32. The manufacture of this case 10 does not therefore necessitate any assembly operation since it consists of a single part.

During the operation of packaging the blister pack 12 in the case 10, an operator places the blister pack 12, with the cells 16 uppermost, on the bottom 20 between the pins 48 as illustrated by the arrow F in FIG. 1, the case 10 being unfolded, with its three sections 20, 32 and 60 horizontal such as they are on removal from the mould.

Then, the flap 32 is folded down on top of the blister pack 12 against the bottom 20. The blister pack 12 is therefore automatically positioned since the folding formed at the level of the front hinge 34 by the flap 32 and the bottom 20 pushes the blister pack 12 which is guided laterally into position by the lateral pins 48L and is stopped when butted against the frontal pins 48F.

The pits 54 of the flap 32 are then brought vertically into contact with the pins 48 which penetrate through the lower openings 52. The convex head 50 of the pin 48 elastically separates the two halves of the pit 54. The pit 54 then returns elastically to its original shape against the pin 48, under the head 50. The pairs of fixing elements 44 and 46 are then in an interlocked position and the flap 32 thus traps the blister pack 12 against the bottom 20 in such a way that it cannot be dismantled.

Because of this case 10, it is not necessary to position the blister pack 12 exactly in the case 10 since the exact positioning is obtained when the flap 32 is folded down and then fixed. This method of fixing is advantageously fast and does not call upon any external means.

During the use of the case 10, the user grasps the closed case 10 by supporting the lower face of the bottom 20 in the palm of his hand and by squeezing the two long lateral sides 26 and 28 between his fingers. Then he uses his other hand to open the lid 60 of the case 10 by raising the protrusion 74. Finally, with a finger, he presses the cell 16 containing the desired medicine 19 in order to eject it through the hole 42 in the bottom 20, into the palm of his hand which is supporting the case 10.

Such a case 10 makes any attempt at tampering with it in order to remove the blister pack 12 difficult.

In fact, as the flap 32 is surrounded very closely by the rim 30 of the bottom 20, it is difficult to obtain purchase for inserting a lever into the interstice between the flap 32 and the bottom 20 for the purpose of raising the flap 32.

It is also difficult to attempt to separate the blades 54 which edge the interlock orifice 52 of the flap 32 in order to release the head 50 of the corresponding pin 48 since the periphery of the orifice 52 is protected by the skirt 58. Furthermore, it would be necessary to carry out this operation simultaneously on the six fixing means because of the rigidity of the flap 32.

Therefore, the only method of reaching the blister pack 12 is to cut off the heads 50 of each pin 48, which leaves traces that cannot be eradicated. That is to say that, in the case of tampering, the case 10 bears traces that are impossible to camouflage.

In a variant of the invention, which is not shown, the flap 32 and the bottom 20 are two separate parts.

The invention claimed is:

1. A protective case (10) for a blister pack (12) containing medicines (19) intended for clinical trials, the blister pack having a semi-rigid horizontal upper panel (14) with blister-shaped cells (16) delimiting housings which are obturated by covers (17) and each of which contains a medicine (19) able to be expelled through a flat lower face (18) of the blister pack (12) by tearing the respective cover (17), the case (10) comprising:

a horizontal bottom (20) of rigid plastic upon which the lower face (18) of the blister pack (12) lays, the bottom having holes (42) coinciding with locations of the cells; and an upper panel (32) of rigid plastic which covers an upper face (14) of the blister pack (12), the upper panel having holes (40) coinciding with locations of the cells, the blister pack (12) being trapped between the bottom (20) and the upper panel (32); and elastic interlocking means (44, 46) that cannot be dismantled for fixing the upper panel (32) with respect to the bottom (20).

2. The case (10) as claimed in claim 1, wherein the elastic interlocking means comprises at least one pin (48) forming a stop for the horizontal positioning of the blister pack (12) with respect to the holes (42) in the bottom (20).

3. The case (10) as claimed in claim 2, wherein the at least one pin (48) constitutes a male element (44) of the elastic interlocking means, an associated female element (46) of the elastic interlocking means being carried by the upper panel (32).

4. The case (10) as claimed in claim 3, wherein the male element (44) and the associated female element (46) are each formed in one piece with the bottom (20) and with the upper panel (32) respectively.

5. The case (10) as claimed in claim 1, the bottom (20) comprises a rim (30) that extends vertically upwards and which surrounds the upper panel (32).

6. The case (10) as claimed in claim 5, further comprising an upper lid (60) for protecting the cells (16) which is made of rigid plastic and which is mounted such that it pivots with respect to the bottom about a second hinge (62) between a closed position in which it envelopes the cells (16) of the blister pack (12) by cooperation of its shape with that of the bottom (20), and an open position in which the cells (16) are accessible to a user.

7. The case (10) as claimed in claim 6, wherein the second hinge (62) is a plastic film which is formed in one piece with the bottom (20) and the lid (60).

8. The case (10) as claimed in claim 7, wherein the lid (60) is held in the closed position by cooperation of complementary shapes (72) between the lid (60) and one of the upper panel (32) and the bottom (20).

9. The case (10) as claimed in claim 6, wherein the lid (60) is held in the closed position by cooperation of complementary shapes (72) between the lid (60) and one of the upper panel (32) and the bottom (20).

10. The case (10) as claimed in claim 1, wherein the upper panel is a flap (32) that is mounted such that it articulates about a transverse axis by means of a first hinge (34) on one side (22) of the bottom (20).

11. The case (10) as claimed in claim 10, wherein the first hinge (34) is formed by a plastic film which is formed in one piece with the bottom (20) and with the upper panel (32).

12. The case (10) as claimed in claim 11, wherein the first hinge (34) forms a stop for positioning the blister pack (12) with respect to the holes (42) in the bottom (20).

13. The case (10) as claimed in claim 11, further comprising an upper lid (60) for protecting the cells (16) which is made of rigid plastic and which is mounted such that it pivots with respect to the bottom about a second hinge (62) between a closed position in which it envelopes the cells (16) of the blister pack (12) by cooperation of its shape with that of the bottom (20), and an open position in which the cells (16) are accessible to a user.

14. The case (10) as claimed in claim 10, further comprising an upper lid (60) for protecting the cells (16) which is made of rigid plastic and which is mounted such that it pivots with respect to the bottom about a second hinge (62) between a closed position in which it envelopes the cells (16) of the blister pack (12) by cooperation of its shape with that of the bottom (20), and an open position in which the cells (16) are accessible to a user.

15. The case (10) as claimed in claim 10, wherein the first hinge (34) forms a stop for positioning the blister pack (12) with respect to the holes (42) in the bottom (20).

16. The case (10) as claimed in claim 15, further comprising an upper lid (60) for protecting the cells (16) which is made of rigid plastic and which is mounted such that it pivots with respect to the bottom about a second hinge (62) between a closed position in which it envelopes the cells (16) of the blister pack (12) by cooperation of its shape with that of the bottom (20), and an open position in which the cells (16) are accessible to a user.

17. The case (10) as claimed in claim 3, wherein the elastic interlocking means is brought into a state that cannot be dismantled by elastic deformation of the female element (46).

18. The case (10) as claimed in claim 1, wherein said elastic interlocking means comprises a pin with one end attached to said bottom and an opposite end with a head and a female element that is integral with said upper panel, said female element including a pit and a skirt that surrounds said pit, said pit having an end with an opening that is smaller than said head of said pin and that is split at said end to receive said pin, and said skirt extending to at least said end to prevent dismantling of said elastic interlocking means.

19. A protective case for a blister pack containing medicine, the case comprising:

a horizontal bottom of rigid plastic having holes for expelling medicine in the blister pack;

an upper panel of rigid plastic that is hingedly attached to said bottom and that has holes coinciding with the holes in said bottom, said bottom and said upper panel being adapted to receive a blister pack therebetween; and plural elastic interlocks that cannot be dismantled and that fix said upper panel to said bottom, each of said interlocks including (a) a pin with one end attached to said bottom and an opposite end with a head and (b) a female element that is integral with said upper panel, said female element including a pit and a skirt that surrounds said pit, said pit having an end with an opening that is smaller than said head of said pin and that is split at said end to receive said pin, and said skirt extending to at least said end to prevent dismantling of said interlocks.

* * * * *